United States Patent [19]

Whitesides et al.

[11] Patent Number: 4,819,006

[45] Date of Patent: Apr. 4, 1989

[54] MOUNT FOR SUPPORTING A PARABOLIC ANTENNA

[75] Inventors: Robert B. Whitesides; Lyle W. Hovland, Murrysville, both of Pa.; Robert F. Crean, Woodstock, Vt.

[73] Assignee: Aluminum Company of America, Pittsburgh, Pa.

[21] Appl. No.: 860,989

[22] Filed: May 8, 1986

[51] Int. Cl.[4] ..... H01Q 1/12

[52] U.S. Cl. ..... 343/880; 343/765; 248/278; 248/514; 403/408.1

[58] Field of Search ..... 343/880, 882, 883, 765; 403/408; 248/40–41, 42, 43

[56] References Cited

U.S. PATENT DOCUMENTS

| | | | |
|---|---|---|---|
| 2,575,254 | 11/1951 | Blaugrund | 248/43 |
| 3,094,303 | 6/1963 | Belger | 248/40 |
| 3,171,666 | 3/1965 | Benjamin | 403/371 |
| 3,333,802 | 8/1967 | Goodman | 248/43 |
| 4,232,320 | 11/1980 | Savalle, Jr. | 343/765 |
| 4,427,318 | 1/1984 | Kaminski | 403/408 |
| 4,474,493 | 10/1984 | Welch | 403/405 |
| 4,510,502 | 4/1985 | Hovland et al. | 343/880 |
| 4,617,572 | 10/1986 | Hugo | 343/882 |
| 4,644,365 | 2/1987 | Horning | 343/882 |

FOREIGN PATENT DOCUMENTS

| | | | |
|---|---|---|---|
| 0015307 | 1/1984 | Japan | 343/882 |
| 0172806 | 9/1984 | Japan | 343/882 |

*Primary Examiner*—William L. Sikes
*Assistant Examiner*—Doris J. Johnson
*Attorney, Agent, or Firm*—Max L. Williamson; David W. Brownlee

[57] ABSTRACT

A mount for connecting a satellite television antenna to a pipe mast. The mount includes a support assembly of a linear upright member and a cross member which are adapted for attachment to a peripheral portion of a parabolic dish antenna and a fitting attached to a lower end of the upright member which connects with a pipe mast so as to enable or prevent rotation of the support assembly with respect to the mast axis and to enable or prevent varying the angle of inclination of the upright member with respect to vertical.

13 Claims, 5 Drawing Sheets

MOUNT FOR SUPPORTING A PARABOLIC ANTENNA

BACKGROUND OF THE INVENTION

The present invention relates to a mount for supporting an antenna for receiving a signal from or sending a signal to a satellite in a geostationary orbit about the earth. More particularly, it relates to a mount for attaching an antenna to a pipe mast embedded in the ground or firmly anchored to a building structure with the mount adapted to enable aligning the antenna with the satellite target and thereafter lock the antenna securely in place.

Within a relatively short time, a thriving and growing business has developed in providing satellite transmitted television. An essential element of any system for receiving and transmitting microwave signals from and to a satellite is a suitable antenna which typically includes a parabolic dish. Because of the relatively low transmission power and distance a signal must travel from a satellite, the antenna dishes have been substantial in size and have required relatively large structural support systems to maintain the antenna in a fixed position with respect to the satellite, to maintain the parabolic shape, and to fix the location of the feed horn and outdoor electronic unit with respect to the dish.

The rapidly growing market for equipment for transmitting and receiving microwave signals to and from satellites has been accompanied by increasing numbers of manufacturers and sellers of such equipment and has fueled a continuing effort to improve the equipment and reduce its costs. One of the benefits of the improvements which have been made in the equipment is a reduction in the size of antennas required for reasonably good reception. Whereas in the past a 10-foot diameter was considered the minimum acceptable for the dish, many systems now have 6-foot diameter dishes. Reducing the size of the antenna dish is desirable because of the potential for savings in material for the dish and the size and the amount of material in the support system. In addition, many prospective buyers of home satellite television systems have been deterred from buying because of the negative impact on the aesthetics of the home from a large antenna. The smaller the antenna and the support system, the lesser is the aesthetic problem and the greater the likelihood of acceptance of a satellite television system by a potential customer.

SUMMARY OF THE INVENTION

This invention is a mount for a parabolic dish antenna which is adapted for attachment to a pipe or tube mast or post embedded in the ground or firmly anchored to a building or other structure. The dish is attached to a tubular support assembly which is connected to the mast with a fitting assembly adapted to enable the antenna dish to be precisely aligned with a target satellite and then be securely locked in place.

It is an objective of this invention to provide an economical antenna mount.

It is also an objective of this invention that it comprise a minimal number of easy to fabricate parts.

It is a further objective that the parts can be made from standard readily available materials.

It is another objective that the invention be simple to assemble and that a desired azimuth and elevation setting can be precisely made.

It is also an objective that the antenna assembly present an aesthetically acceptable appearance.

These and other objectives and advantages will be more apparent with reference to the following description of a preferred embodiment and accompanying drawings.

BRIEF SUMMARY OF THE INVENTION

DESCRIPTION OF A PREFERRED EMBODIMENT

A preferred embodiment of this invention is described with reference to its use in supporting a 1.2 meter offset parabolic dish, a feed horn and an outdoor electronic unit, also known as a low noise amplifier (hereinafter referred to as LNA), for example. The invention is not limited to any specific size of antenna, nor is it limited to an offset type.

Figure 1:
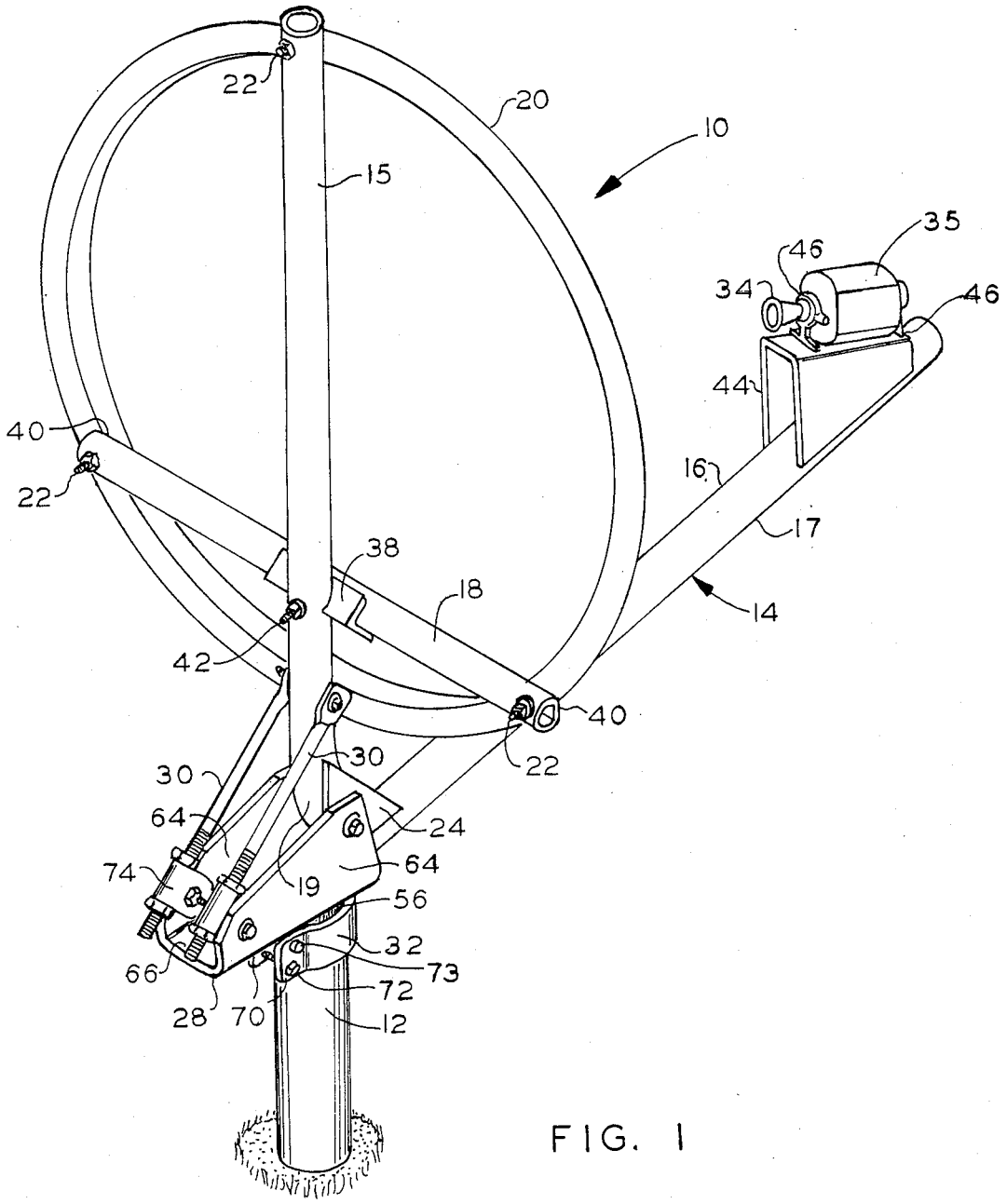
FIG. 1 is a perspective view from the rear of a mount of this invention with an offset antenna dish, feed horn and a low noise amplifier mounted thereon.

With reference first to FIG. 1, the antenna and mount assembly 10 is shown attached to an unbraced pipe mast 12 embedded in concrete in the ground. Because of high loads from the wind acting on antennas having surface areas equivalent to a circle one meter and larger in diameter, such antennas will usually be ground mounted. It is noted, however, that a mount of this invention can also be attached to a mast or pipe or tube projecting from a roof or some other building element if the connection and the building structure are able to sustain the design wind load imposed upon the antenna.

The tubular support assembly 14 is comprised of a formed or bent central tube 16 having an upright portion 15 and a substantially horizontal portion 17 connected by an arcuate portion 19. A cross tube 18 is attached at its midpoint to the upright portion 15 of the central tube 16 with their axes perpendicular to one another. The antenna dish 20 is attached with bolts 22 to the tube assembly 14 at three points of connection. Although bolts have been used in this preferred embodiment as connectors, it is understood that other connectors, such as screws, rivets, clamps, etc., may also be used. Triangular gussets 24 are welded on each side of arcuate portion 19 of the central tube 16 to strengthen the tube and assist in effecting attachment of the tubular assembly 14 to the mounting bracket 28, as will be explained later.

Fabrication and assembly of a mount of this invention is simply accomplished using conventional tools and standard materials. The tubular assembly 14 is made from pipes or tubes having the structural characteristics necessary to support an antenna of a desired size under specified design conditions. For example, the mount for a 1.2 meter dish antenna is designed to limit the deflection of the dish at any point to 0.100 inch with a 50 mph wind imposed upon the system from any direction. The length of the upright portion 15 of the central tube 16 and cross tube 18 is determined with respect to the size of the antenna dish since the upright portion and cross tube 18 must accommodate the dish. It may be seen that the length of the cross tube 18 depends upon the preferred location of the attachment points on the peripheral edge of the dish. Generally, dishes have either an elliptical peripheral shape for offset antennas or a circular peripheral shape for center mount antennas. It is desirable that the points of attachment be at locations which produce an evenly distributed load on the connection points when the antenna is under its most adverse design load conditions. For a given size and shape, the preferred connection points can be determined mathematically, but the preferred method, at least with respect to an elliptical offset antenna, is to make the determination on the basis of wind tunnel testing. The substantially horizontal portion 17 of the central tube 16 must be long enough to position the feed horn 34 and LNA 35 at the proper distance from the dish.

After the size and length of the tubes have been determined, the central tube 16 is bent at the proper point to a predetermined angle. The angle is critical because the distance of the feed horn and LNA from the dish and their angular relationship with respect to the dish are important to optimize reception of a signal from a satellite. The bend can be made with conventional tube or pipe bending equipment and should be made with as much care as possible.

Figure 2:
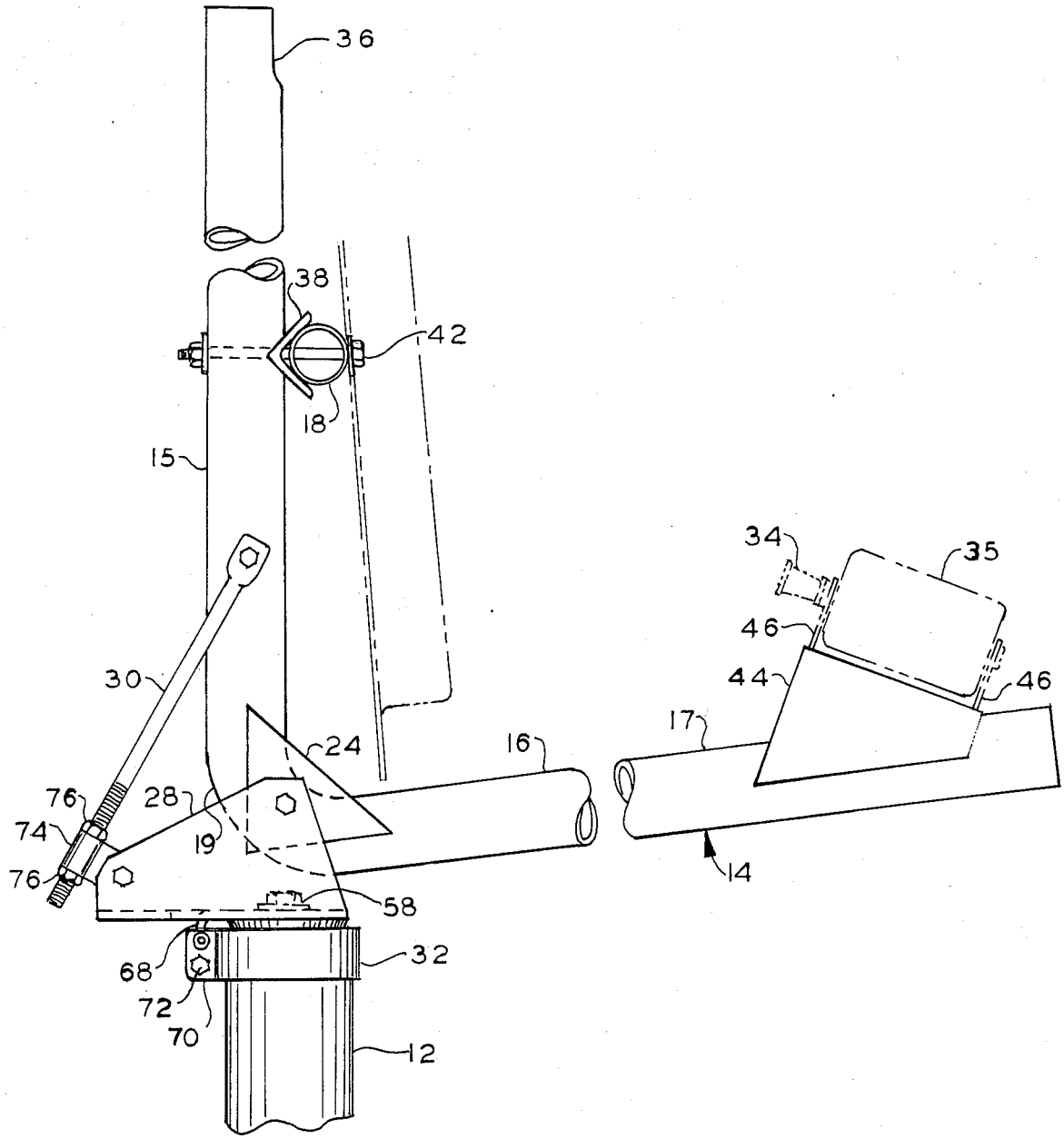
FIG. 2 is a side elevation view of a mount of this invention.
Figure 3:
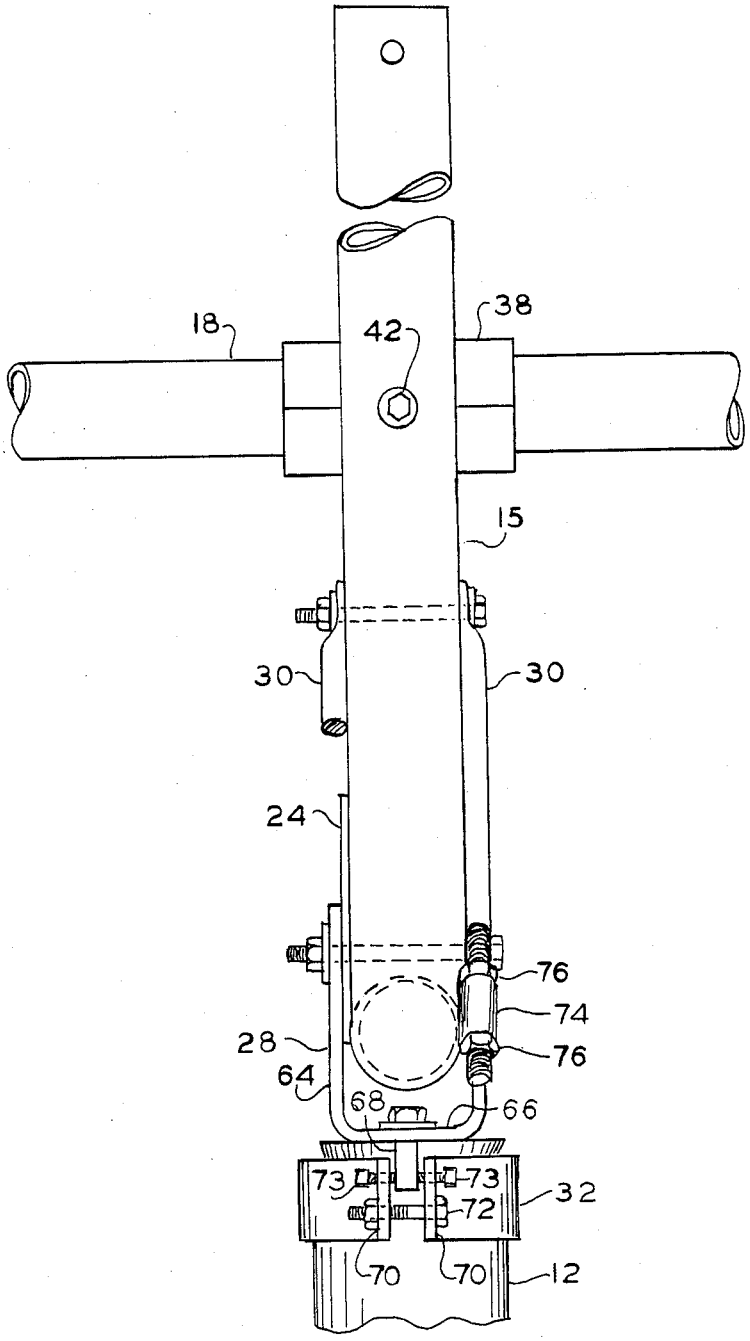
FIG. 3 is a rear elevation view of the mount shown in FIG. 2.

Referring now to FIGS. 2 and 3, as well as FIG. 1, after the bend has been made, the side of the tube 16 on the inside of the bend is flattened on the upper end of the upright portion 15 to provide a seat 36 for the flange on the dish and a hole is provided therethrough to accommodate the dish attachment bolt 22. Next, the location for the cross tube 18 is carefully made by providing a hole through the upright portion 15 of the central tube 16 at a predetermined distance away from the bolt hole through the flattened end. It may be seen that this predetermined distance is derived from either mathematical calculation or wind tunnel tests to find the preferred locations for connections. A cross tube seat 38 is made from a short length of a suitable size angle to accommodate the cross tube 18. A center portion of the seat 38 is coped to fit the upright portion 15 of the central tube and then welded with its outwardly extending legs equally angled from above and below the axis of the cross tube bolt hole. To complete the fabrication of the central tube 16, triangular gusset plates 24 are welded on each side of the arcuate portion 19. The gussets serve to stiffen and strengthen the tube at the bend to maintain the correct bend and also support the connection of the tubular assembly 14 to the fitting assembly 26.

The cross tube 18 has a bolt hole at its center and bolt holes through flattened end portions 40. The cross tube 18 is assembled with the central tube 16 by seating it in the angle 38 and fastening it in place with the bolt 42.

As has been previously noted, bending the central tube to the proper angle is important. Precise positioning of the holes for dish bolts 22 and cross tube bolt 42 is also important. It is understood, however, that with the use of jigs and fixtures, one skilled in the art of metal fabrication can effect such fabrication within a range of practical tolerance limits. Dimensional variations within typical manufacturing limits in fabricating and assembling the tubular assembly 14 can be cared for in attaching the feed horn and LNA mount 44 to the substantially horizontal portion 17 of the central tube 16. The feed horn mount 44 is a U-shaped bracket sized to fit the horizontal portion 17 of the pipe snugly within its legs. The feed horn 34 and LNA 35 are supported by a pair of clips 46 which are attached to the outer surface of the base of the bracket 44. Using the dish mounting holes in the end of the upright portion 15 of the tube and the ends of the cross tube 18 as reference points, the feed horn mount 44 can be positioned and welded on the central pipe so that the feed horn 34 and LNA are mounted with respect to the antenna dish with a high degree of precision. Thus, the ability to precisely position and weld the feed horn and LNA mount 44 to the support compensates for tolerance variations which may have arisen in the fabrication and assembly of materials and parts.

Figure 4:
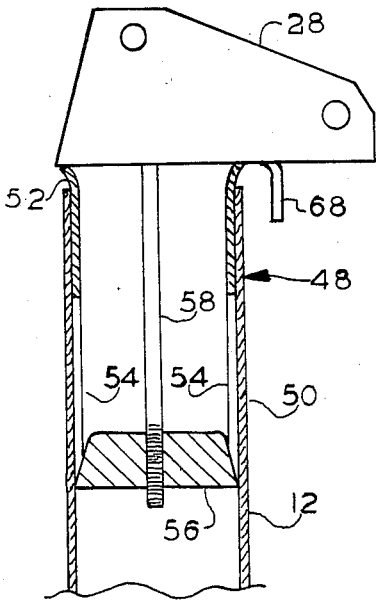
FIG. 4 is a cross-sectional view of a side 90° from the side of the torque lock and mounting bracket shown in FIG. 6.
Figure 5:
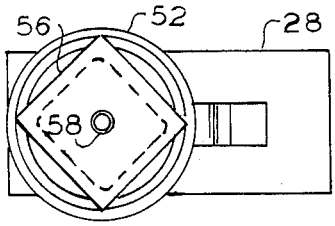
FIG. 5 is a bottom end view of the torque lock and mounting bracket shown in FIG. 4.
Figure 6:
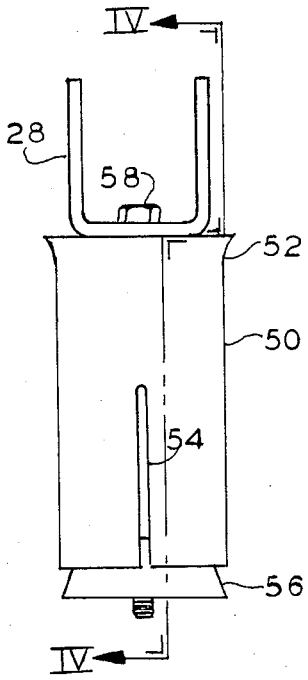
FIG. 6 is a side elevation view of a torque lock attached to a mounting bracket of a mount of this invention.

An important element of the invention is the torque-lock 48 shown in FIGS. 4, 5 and 6. The torque lock 48 fits inside the mast 12 and, in combination with the adjustment strap 32, as shown in FIGS. 1 and 2, provides means for engaging the tube assembly 14 with the mast 12 and for quickly and simply making the necessary azimuth setting of the antenna with respect to a satellite target. The torque lock 48 is made from a short length of tube 50 having an outside diameter which fits snugly within the mast 12 without binding. The upper end 52 of the tube 50 is coined to flare outwardly and is attached to the bottom wall of the tubular assembly mounting bracket 28 by welding. Four equally spaced slots 54 are cut upwardly from the bottom of the tube 50 for expansion purposes, as will be discussed later. An expansion block 56, which is a frustum of a regular square pyramid, is threaded on a bolt 58 extending downward through the bracket 28 and tube 50. The block 56 is sized so that it fits partially within the bottom end of the tube 50.

Other elements of the invention in providing the means for engaging the tube assembly 14 with the mast 12 are the tube assembly mounting bracket 28, the angle adjusting rods 30 and the azimuth adjusting strap 32. The tube assembly mounting bracket 28 shown in FIGS. 1, 2 and 3 is U-shaped in cross section with irregularly shaped sidewalls 64. The sidewalls on the end which connects to the tube assembly 14 are high enough to enable the assembly to be sufficiently clear of the mounting base bottom wall 66 to enable the assembly to be rotated about the bolt used to connect the bracket 28 and tube assembly 14, as will be discussed later. The inside space dimension between the sidewalls 64 is sufficient to accommodate a slip fit of the arcuate portion 19 of the central tube 16 having the gussets 24 welded thereto. The mounting bracket 28 also includes a tab 68 projecting downward from the bottom wall 66 to fit between adjusting screws in the adjustment strap 32. Positioning of the tab 68 and method of adjusting will be discussed later. In this embodiment, the tab 68 is provided by bending down a cut portion of the bottom wall 66. As an alternative, the tab 68 can be a separate cut piece welded to the bottom wall centerline for connecting with the adjustment strap 32. The adjustment strap 32 is simply a piece of metal strip formed with a proper radius to circumscribe the mast 12. It includes opposing spaced apart end flanges 70 having a pair of bolt holes therethrough for the strap tightening bolt 72. An upper pair of holes are for cap screws 73 which screw against opposing sides of the bracket tab 68 for adjusting the azimuth, as will be discussed later.

The remaining element in the fitting assembly 26 is the pair of angle adjusting rods 30. They are identical and are made from a rod which has one end flattened with a bolt hole therethrough and has an opposing threaded end. A swivel 74 is secured on the threaded end with an upper and lower adjusting nut 76. The swivel is made from a metal strap by forming one end into a cylinder having an inside diameter large enough to slip fit over the threaded rod end and providing a hole in the opposing end of an unformed portion for attachment to the bracket 28. Two rods 30 are preferred if maximum stability of the antenna 10 is desired, but in some applications one rod may suffice.

Assembly and installation of the antenna are easily made. Typically, the just-described pieces and parts would be completely fabricated and ready to assemble when shipped to the erection site. As a matter of choice, some of the pieces may be assembled and shipped as assemblies. For example, the bracket 28 and torque lock 48 would usually be assembled and the adjusting rods 30 could be attached thereto. At the erection site, the pipe mast 12 would first be anchored in the ground or to a building structure, as the case may be.

The sequence of assembling the various pieces and attaching the mount and antenna assembly 10 to the mast is largely a matter of choice. The following description is one of several which might be followed in erecting the antenna.

The cross tube 18 is seated in the cross tube seat 38 and is connected to the upright portion 15 of the central tube 16 with bolt 42. Next, the antenna dish 20 is attached to the tubular assembly with bolts 22 through the dish flange and the tube ends. If the rods 30 have not been attached to the bracket 28, the next step would be to do so. First, the swivels 74 are slipped onto the adjusting rods 30 and retained thereon between the adjusting nuts 76. Then the swivels 74 are bolted to the mounting bracket sidewalls 64. Next, the adjusting strap 32 is bolted loosely to the mast 12.

Then the bracket 28 is attached to the mast 12 by dropping the torque lock 48 into the mast. It may be seen that the outwardly flaring coined end 52 provides a uniform contact around the periphery of the tube at the mast end. The torque bolt 58 then can be finger tightened. Next, the arcuate portion 19 of the central tube 16 having the gussets 24 welded thereto is positioned between the mounting bracket sidewalls 64 and the assembly bolt installed. The flattened ends of the adjusting rods 30 can then be bolted to the upright portion 15 of central tube 16 and the feed horn 34 and LNA 35 attached to the feed horn and LNA mount 44.

The antenna is then ready for positioning with respect to the target satellite. To make the proper azimuth alignment, the torque lock bolt 58 and strap adjusting bolt 72 should be loose enough to allow the antenna 10 to be freely rotated with respect to the mast 12. When the dish is in proper alignment or nearly so, the strap adjustment bolt 72 should be tightened to clamp the strap 32 around the mast. Then a very fine, precise azimuth adjustment can be made by loosening or tightening, as necessary, the opposing adjustment screws on each side of the tab 68. When it is in correct alignment, the torque lock bolt 58 is forcibly tightened. As the bolt is tightened, the expansion block 56 is drawn upward into the tube 50. This action wedges the upper tube end 52 tightly into the mast 12 and causes the lower slotted end to expand into tight frictional contact with the mast without deforming the tube or mast. Thus, the lock can be loosened and retightened if it is desired to lock the antenna onto a different satellite target. To vary the angle of the dish 20 to align the dish with the target satellite, the rod adjustment nuts 76 are turned up or down as required until the dish is properly aligned.

Figure 7:
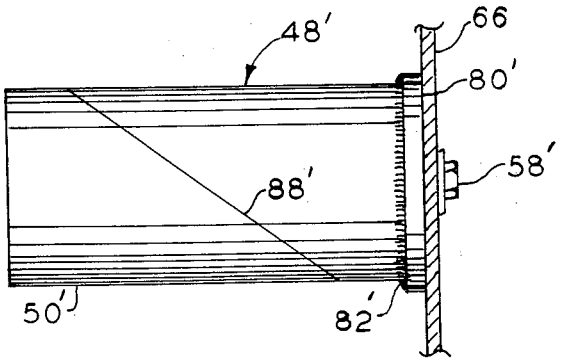
FIG. 7 is a side elevation of an alternate embodiment of a torque lock element of a mount of this invention.
Figure 8:
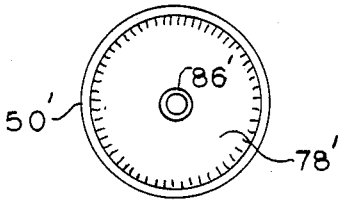
FIG. 8 is a bottom end view of the torque lock shown in FIG. 7.
Figure 9:
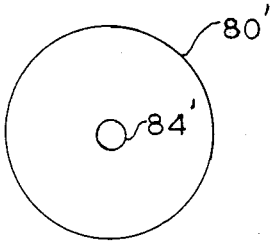
FIG. 9 is a top end view of the torque lock shown in FIG. 7.

An alternate torque lock 48' is shown in FIGS. 7, 8 and 9. A short length of tube 50' has an outside diameter which fits snugly within the mast 12 without binding. A first circular disc 78' is cut to fit inside the tube 50' and welded in one end. A second circular disc 80' is welded to the opposing end of the tube. It has a diameter larger than the outside diameter of the tube 50' so as to provide a flange 82' projecting outwardly from the tube. Center holes are provided in the discs; the hole 84' in the second disc 80' is large enough to pass a torque bolt 58' through, and the hole 86' in the first disc 78' is sized and tapped for threadable engagement with the bolt. After the ends 78', 80' are welded to the tube, the torque lock assembly is divided into halves by making a bias cut 88' on the tube. This lock 48' is used in a manner similar to that described with respect to the first described torque lock 48. The lock 48' is loosely assembled with the bracket 28 with the end having the outwardly projecting flange 82' in contact with the bracket bottom wall 66. The torque lock 48' is then inserted into the mast 12. After the antenna 10 has been aligned in azimuth as previously explained, torque bolt 58' is firmly tightened. The bolt 58' draws up the bottom half of the tube 50' causing the two halves to slide along the bias cut, wedging the lock 48' inside the mast 12.

The invention includes a number of distinctive features. All of the parts can be made from readily available materials and require a minimal amount of fabrication. The fabrication that is required can be accomplished with ordinary metalworking tools. Erection of the mount at the job site involves assembly of a small number of pieces, and the assembly can be quickly made with only a pair of wrenches.

It is also notable that the dish is attached to the mount along its flanged peripheral edge. The parabolic reflector surface, therefore, is uniformly smooth and even with no bolts through it and no special bracing or fittings required on the back side to effect attachment. Attaching at a plurality of locations around the peripheral edge also better distributes the wind load and minimizes the stresses at the connection points. It may be seen that a center attached dish would be much more susceptible to flutter or racking in a gusting wind which might not only adversely affect the quality of reception, but ultimately loosen or weaken materials at the connection.

Although the preferred embodiment has been described with reference to supporting an offset feed horn, it is apparent that it is also suitable for supporting an antenna having a center mounted feed horn. If the antenna were of a center mounted feed horn type, it is apparent that the substantially horizontal portion 17 of the central member 16 could be eliminated.

What is claimed is:

1. A mount for connecting a parabolic dish television antenna to a hollow pipe mast to receive or send signals to a satellite, comprising:

a support having a linear upright member and a linear cross member attached at its midpoint to the upright member with their axes perpendicular;

means for attaching a peripheral portion of a parabolic dish antenna to the support; and a fitting assembly attached to the lower end of the upright member having a torque lock adapted to fit within a pipe mast to connect the support to the mast and having means to selectively increase or decrease the diameter of the lock within the mast to enable or prevent rotation of the support about the mast axis, and means for enabling or preventing variation of the angle of inclination of the upright member with respect to vertical.

2. A mount as claimed in claim 1 wherein the fitting assembly further includes a strap formed to circumscribe the mast which also has means for tightening or loosening the strap about the mast in order to enable or prevent rotation.

3. A mount as claimed in claim 1 wherein in the fitting assembly is pivotably attached to the lower end of the upright member and the means for enabling or preventing variation of the angle of inclination of the upright member with respect to vertical is a rod having one end pivotable attached to the upright member above the upright member's point of pivoted attachment to the fitting, sloping outwardly and downwardly from the upright member to a pivoted connection of its opposing end with the fitting assembly, and means for adjusting the length of the rod between its points of connection with the upright member and the fitting so that the upright member may be pivoted about its connection with the fitting and thereby change its angle of inclination with respect to vertical.

4. A mount as claimed in claim 1 wherein the torque lock is a tube having an outside diameter less than the pipe mast inside diameter and an upper and lower end with a first end disc attached to the lower end of the tube and a second end disc attached to the upper end of the tube and with the tube cut completely through on a bias intermediate its upper and lower ends and with the second end disc having a diameter at least equal to the diameter of the pipe mast and with the first end disc having a diameter not greater than the outside diameter of the tube, and with the first end disc having a tapped center hole for threadable engagement with a bolt and the second end disc having a center hole large enough to accommodate the shank of the bolt therethrough so that the torque lock can be tightened or loosened within the mast by screwing or unscrewing the bolt in the tapped hole in the first end disc.

5. A mount as claimed in claim 1 wherein the torque lock includes:

a tube having an upper and lower end with at least a portion extending upwardly from the lower end a diameter which enables fitting such portion in the mast and also having a plurality of radially spaced slots extending upwardly from the lower end, and with the upper end having a flared portion extending downwardly a distance sufficient to prevent such portion from fitting within the mast; and wedge-shaped block having an upper surface, a lower surface, a side surface tapering outwardly from the upper surface to the lower surface, and a central threaded hole therethrough, with the upper surface having a greatest out-to-out dimension less than the inside diameter of the tube and the lower surface having a greatest out-to-out dimension greater than the inside diameter of the tube; and a bolt extending axially through the portion of the fitting assembly attached to the upper end of the tube and threadably engaging the threaded hole in the block with at least some portion of the block side surface in contact with the lower end of the tube.

6. A mount as claimed in claim 1 wherein the means for attaching a peripheral portion of a parabolic dish antenna to the support is fastener means at the end of the upright member and each end of the cross member.

7. A mount as claimed in claim 6 wherein the fastener means are bolt holes and the cross member is of such length and attached to the upright member at such distance from the bolt hole in the upper end of the upright member that the bolt holes are spaced equidistant with respect to one another.

8. A mount as claimed in claim 1 wherein the support further includes a substantially horizontal linear member having an end connected to the lower end of the upright member and extending away therefrom in a direction normal to the side of the upright member to which the parabolic dish antenna attaches.

9. A mount as claimed in claim 8 wherein the horizontal member is integral with the upright member and connected by an arcuate portion.

10. A mount as claimed in claim 1 wherein the fitting assembly includes a U-shaped bracket having a base and upwardly projecting legs and the lower end of the upright member fits between the legs and is pivotably attached to the bracket with a pin means extending through the upright member and the fitting legs.

11. A mount as claimed in claim 10 wherein the torque lock is connected to the bracket base.

12. A mount as claimed in claim 11 wherein the fitting assembly further includes a strap attached to the bracket with the strap having a central portion formed to circumscribe the mast and having straight portions on each end of the central portion projecting radially outwardly therefrom with the straight portions facing and spaced apart from one another with aligned holes therethrough so that a bolt may be insulated through the holes, and by tightening the bolt, the strap central portion can be clamped tightly around the mast to prevent rotation of the fitting assembly about the mast axis.

13. A mount as claimed in claim 10 wherein the upright member is attached to a front end of the bracket and the means for enabling or preventing variation in the angle of inclination of the upright member with respect to vertical is a rod having an end pivotably attached to the upright member above the connection of the upright member to the bracket and having the opposing end pivotably attached to the bracket downwardly and outwardly from the connection between the rod and the upright member, and means for adjusting the length of the rod between the connections with the upright member and the bracket.

* * * * *